US009425528B2

(12) United States Patent
Tsubo

(10) Patent No.: US 9,425,528 B2
(45) Date of Patent: Aug. 23, 2016

(54) CONNECTOR

(71) Applicant: YAZAKI CORPORATION, Minato-ku, Tokyo (JP)

(72) Inventor: Keigo Tsubo, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/750,043

(22) Filed: Jun. 25, 2015

(65) Prior Publication Data

US 2015/0380846 A1 Dec. 31, 2015

(30) Foreign Application Priority Data

Jun. 27, 2014 (JP) ..... 2014-132104

(51) Int. Cl.
*H01R 12/79* (2011.01)
*H01R 12/77* (2011.01)

(52) U.S. Cl.
CPC ..... *H01R 12/79* (2013.01); *H01R 12/772* (2013.01)

(58) Field of Classification Search
CPC ..... H01R 12/79; H01R 12/78; H01R 23/668; H01R 12/592
See application file for complete search history.

(56) References Cited

U.S. PATENT DOCUMENTS 5,904,589 A * 5/1999 Asakawa ..... H01R 12/592 439/495
5,906,504 A * 5/1999 Igarashi ..... H01R 12/79 439/495
6,276,958 B1 * 8/2001 Chih ..... H01R 12/7047 439/357
6,280,240 B1 * 8/2001 Chang ..... H01R 12/89 439/495
6,551,128 B2 * 4/2003 Asai ..... H01R 12/87 439/260

FOREIGN PATENT DOCUMENTS

JP 2010-009915 A 1/2010

* cited by examiner

*Primary Examiner* — Gary Paumen
(74) *Attorney, Agent, or Firm* — Mots Law, PLLC

(57) ABSTRACT

A connector for a flat connecting member having a plurality of circuits includes a terminal provided at an end portion of the flat connecting member and a resin slider that can be assembled to the terminal. When the terminal penetrates through the slider, in the process of this penetration, assembly holes of the terminal are fitted with locking projections of the slider and the assembly of the connector is completed.

11 Claims, 5 Drawing Sheets

CONNECTOR

CROSS REFERENCE TO RELATED APPLICATION

The present application is based on, and claims priority from Japanese Patent Application No. 2014-132104, filed Jun. 27, 2014, the disclosure of which is hereby incorporated by reference herein in its entirety.

TECHNICAL FIELD

The present application relates to a connector for a flat connecting member having a plurality of circuits.

BACKGROUND

In order to make an electrical connection with a circuit board externally, a substrate connector is provided on the circuit board. The substrate connector has a configuration and structure that can connect a flat connecting member. The flat connecting member is an electrical connecting member having a flat shape such as a flexible printed circuit board (FPC), flexible flat cable, and the like, which may be simply called a flat cable. A connector is also provided on a terminal of such a flat connecting member.

JP2010-009915A discloses a conventional connector for a flat connecting member. The conventional connector includes a terminal of the flat connecting member, a slider assembled to the terminal, and a cover which also is assembled to the terminal. In the conventional connector, the terminal is first mounted and fixed on a predetermined position of the slider, and thereafter, the cover is fitted onto the slider so that the mounted and fixed part is covered, thus completing the assembly. That is, the assembly is completed in two steps.

SUMMARY

Since the conventional connector for a flat connecting member has the slider and the cover besides the terminal of the flat connecting member, it is considered that there is room for reducing the number of component parts. Further, regarding the assembly of the conventional connector, since the assembly is performed in two steps, it is considered that there also is room for reducing the number of steps relating to the assembly.

The present application is made in consideration of the above-described circumstances, and it aims to provide a connector which can reduce the number of component parts and which can improve the assembly performance.

In order to solve the above problems, a connector according to an aspect of the present application is a connector for a flat connecting member having a plurality of circuits, and includes a terminal provided at an end portion of the flat connecting member and a resin slider that can be assembled to the terminal. The terminal has assembly holes provided at both sides in a width direction thereof respectively. The slider has a terminal penetration part through which the terminal penetrates and locking projections with which the assembly holes are fitted. The terminal penetration part has a middle holding part which is arranged at an exit side of the terminal penetration part and which holds a middle portion in the width direction of the terminal. The locking projections are arranged at both neighboring sides of the middle holding part respectively, and are formed in a shape that temporarily bend the both sides that are exposed from the terminal penetration part to make the both sides climb thereover.

With such a structure, it is possible to construct the connector with only two components of the terminal of the flat connecting member and the resin slider. The assembly of the terminal with the slider is performed in one step of penetrating the terminal through the slider, and fitting of the terminal with the slider is performed along with the penetration also. Therefore, in the connector according to the aspect of the present application, after the assembly of the terminal with the slider, falling of the terminal or the slider does not occur. As a result, in the connector according to the aspect of the present application, effects of reducing the number of component parts and improving the assembly performance can be achieved.

Each of the locking projections may be formed in a shape having a taper.

With such a structure, the both sides of the terminal that are exposed from the terminal penetration part of the slider are bent while contacting the tapers of the locking projections and climb over the locking projections. By forming the tapers, bending and climbing over can be performed smoothly. As a result, an effect of further improving the assembly performance of the connector can be achieved.

Each of the locking projections may be formed in a shape that protrudes higher than an opening height of the exit of the terminal penetration part.

With such a structure, even if one simply tries to pull out the flat connecting member from the slider, the assembly holes of the terminal do not come off from the locking projections of the slider. Specifically, the middle portion in the width direction of the terminal is held by the middle holding part of the terminal penetration part, and in this state, even if one simply tries to pull out the flat connecting member from the slider, the assembly holes do not come off from the locking projections which protrude higher than the opening height of the exit of the terminal penetration part. As a result, an effect of improving the assembly reliability of the connector can be achieved.

DESCRIPTION OF EMBODIMENTS

Figure 1:
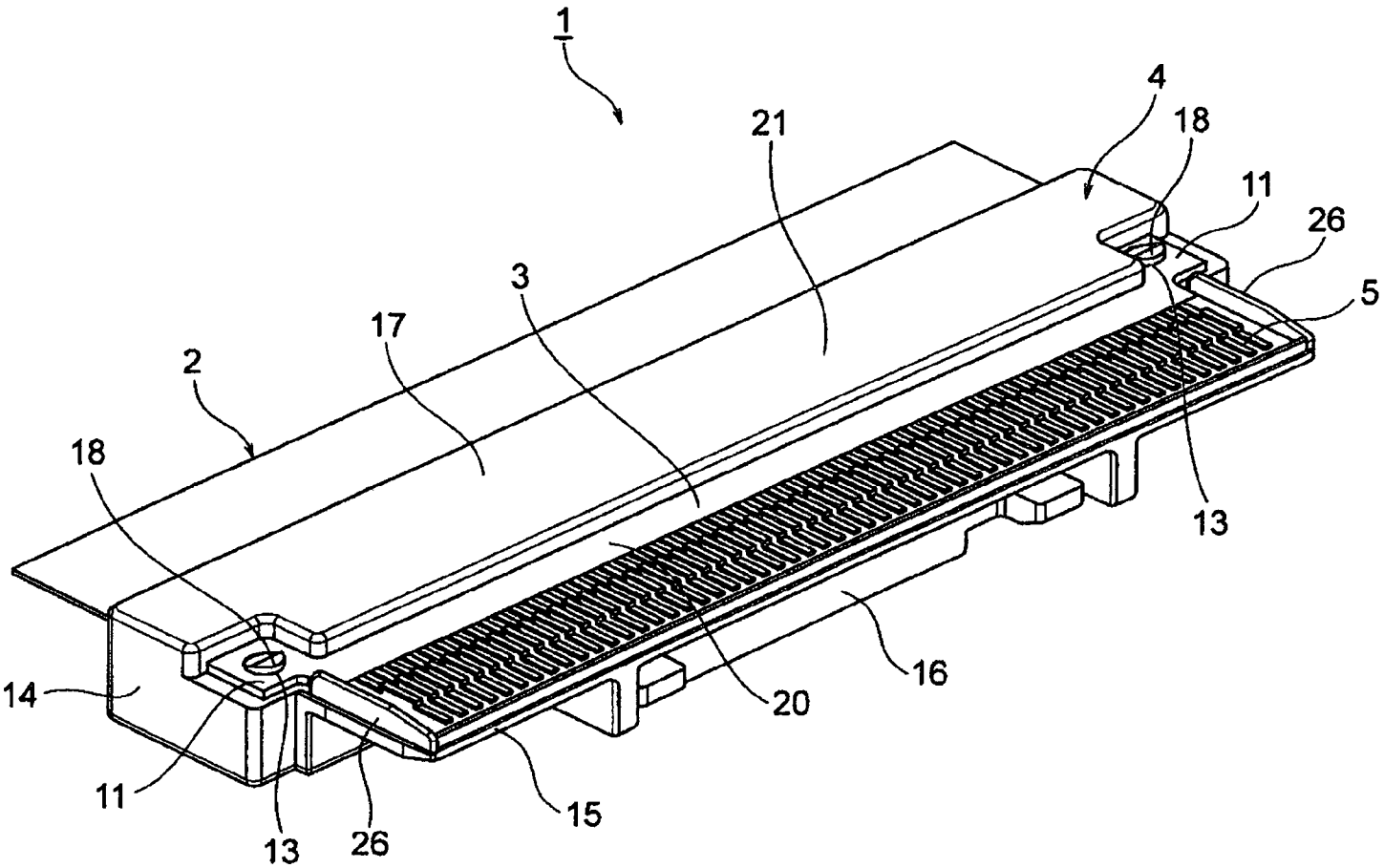
FIG. 1 is a perspective view illustrating a connector according to an embodiment.

A connector for a flat connecting member having a plurality of circuits includes a terminal provided at an end portion of the flat connecting member and a resin slider that can be assembled to the terminal. When the terminal penetrates through the slider, in the process of this penetration, assembly holes of the terminal fit into locking projections of the slider, thus completing the assembly.

Hereinafter, an embodiment will be explained by referring to the drawings.

As illustrated in FIG. 1, a connector 1 according to the embodiment is used for connecting a flat connecting member 2 having a plurality of circuits, and includes a terminal 3 provided at an end portion of the flat connecting member 2 and a resin slider 4 that can be assembled to the terminal 3. The connector 1 is formed such that it mechanically fits with a substrate connector (not illustrated) mounted on a circuit board (not illustrated) and electrical connection is made along with this fitting.

Figure 2:
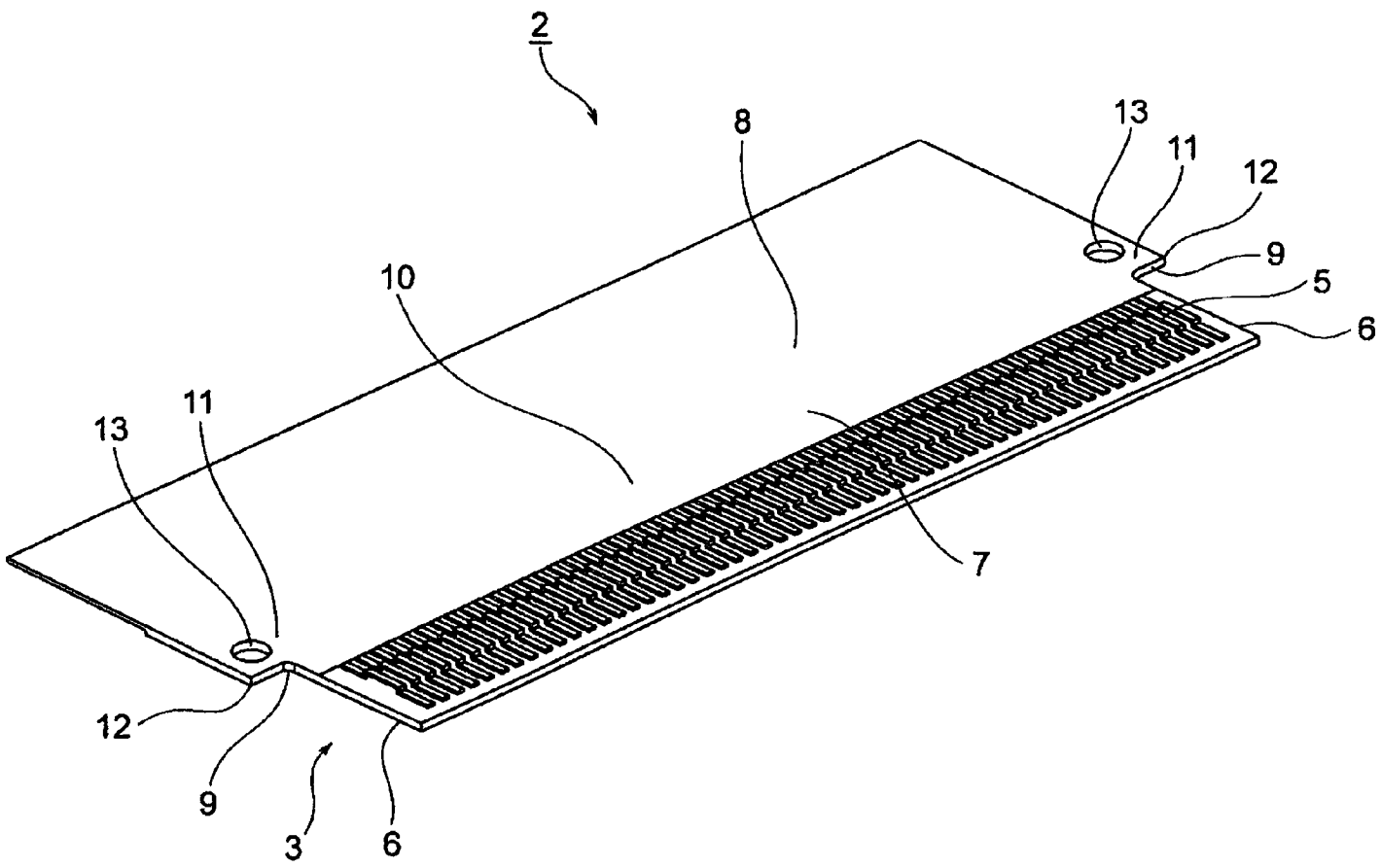
FIG. 2 is a perspective view illustrating a flat connecting member of FIG. 1.
Figure 3:
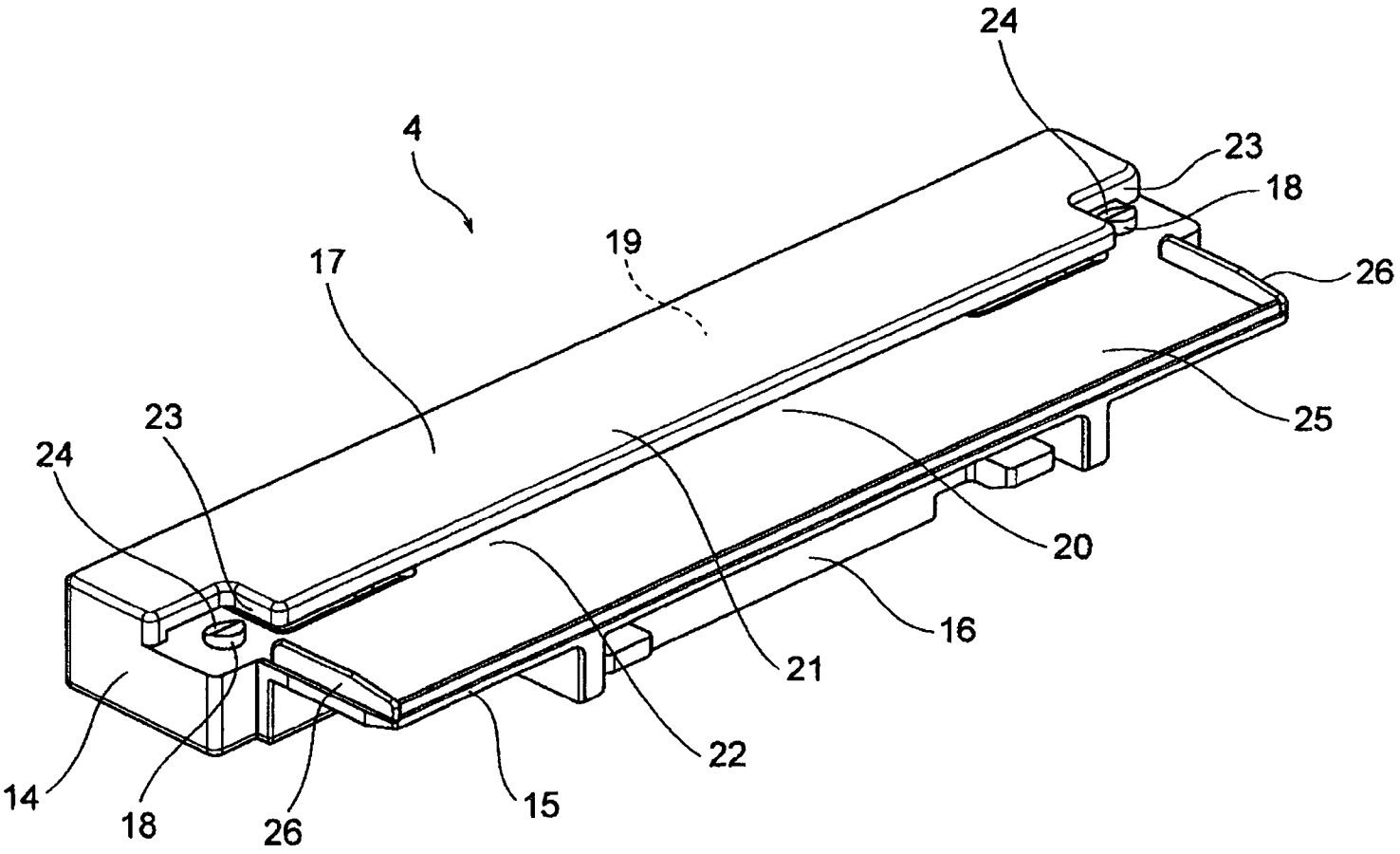
FIG. 3 is a perspective view illustrating a slider of FIG. 1.
Figure 4:
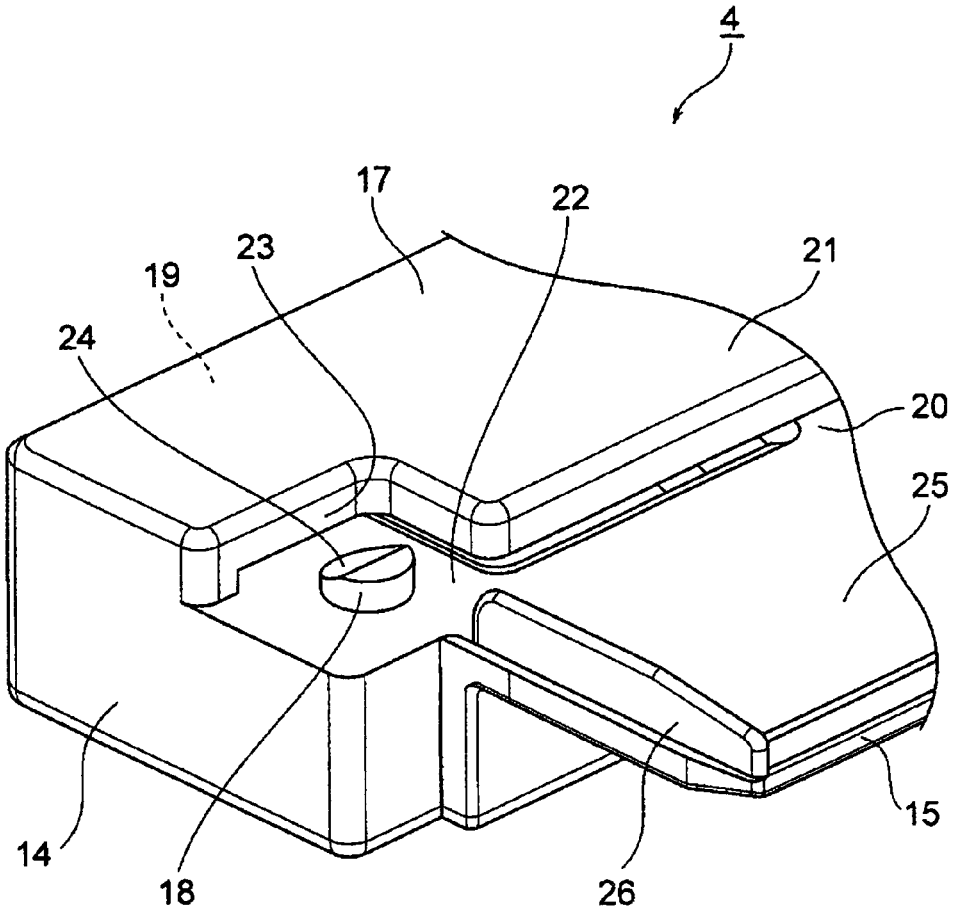
FIG. 4 is an enlarged perspective view illustrating a locking projection and its periphery of FIG. 3.
Figure 5:
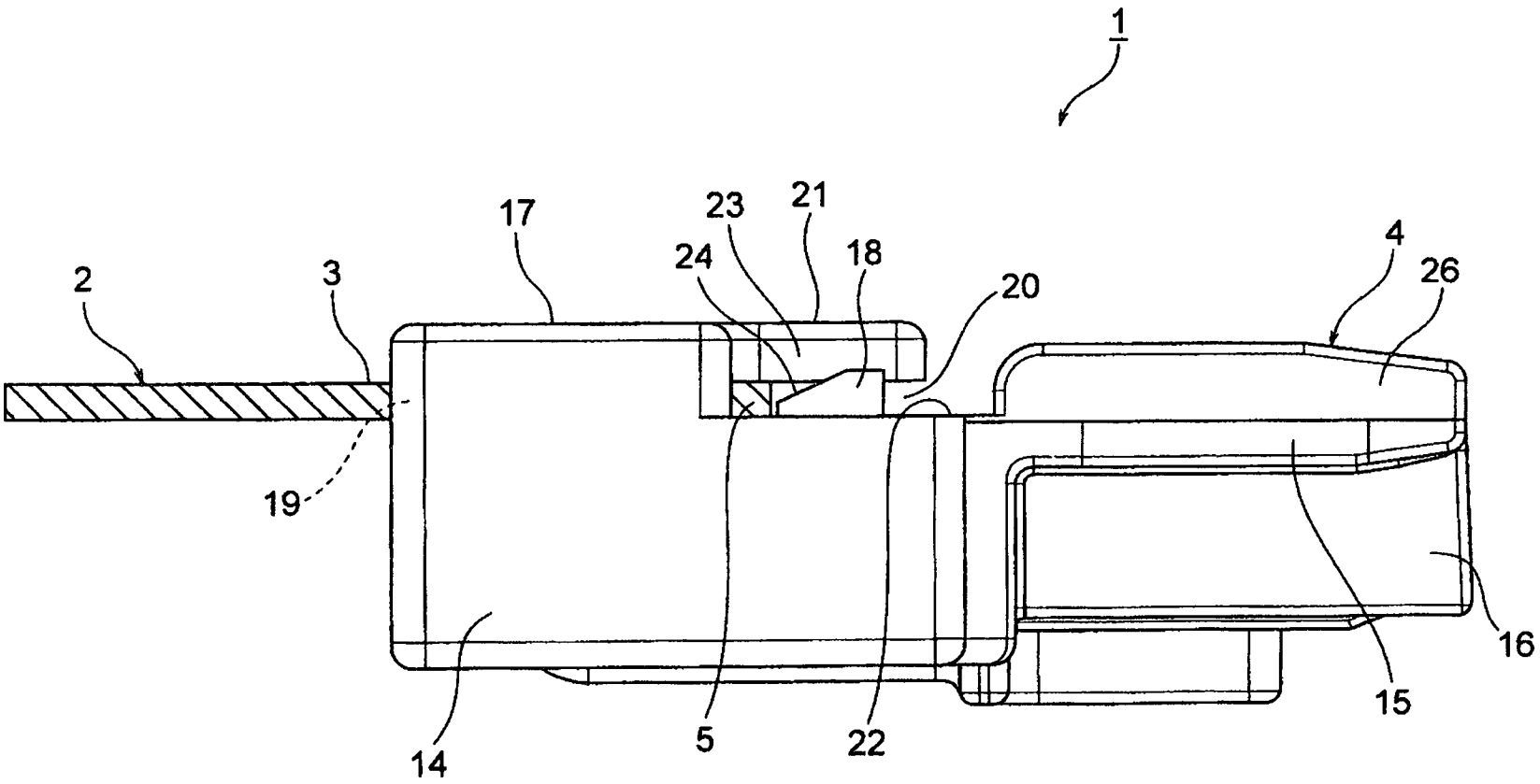
FIG. 5 is a side view illustrating an assembly state of the connector according to the embodiment.

As illustrated in FIGS. 1 and 2, the flat connecting member 2 is the so-called flat cable, and specifically, it corresponds to a flat electrical connecting member such as a flexible printed circuit board (FPC), flexible flat cable (FFC), and the like. The flat connecting member 2 is formed with various conditions such as a predetermined width, number of circuits, length, and the like. In the embodiment, a flexible printed circuit board (FPC) is adopted as the flat connecting member 2.

A connector connecting part 5 for electrical connection with the substrate connector (not illustrated) is formed on the terminal 3 of the flat connecting member 2. The connector connecting part 5 is formed also as a portion accommodated in a connecting member housing of the substrate connector. The connector connecting part 5 is formed over the whole width at the end portion of the terminal 3. Strip-like terminals are exposed at the connector connecting part 5. Guide portions 6 are formed respectively at both sides in the width direction of the connector connecting part 5. The pair of guide portions 6 are formed as the portions guided by terminal guide portions 26 of the slider 4.

A holding fitting part 7 as a portion that is continuous from the connector connecting part 5 and an accommodation part 8 as a portion that is further continuous from the holding fitting part 7 are formed on the terminal 3. The terminal 3 is formed such that from this end, the connector connecting part 5, the holding fitting part 7, and the accommodation part 8 are arranged in order. The holding fitting part 7 and the accommodation part 8 are formed to be wider than the connector connecting part 5. Since the holding fitting part 7 and the accommodation part 8 are formed wider than the connector connecting part 5, stepped portions 9 generated by this difference in width are formed between the holding fitting part 7 and the connector connecting part 5.

The holding fitting part 7 is formed with its middle portion 10 in the width direction as the part to be held by a middle holding part 21 of the slider 4. Further, both sides 11 in the width direction (the sides 11, 11) of the holding fitting part 7 are formed as portions that fit with locking projections 18 of the slider 4. The middle portion 10 is formed as a portion that is flat on the front and back faces.

The both sides 11 of the holding fitting part 7 are formed at a section that includes part of the stepped portions 9, 9. The both sides 11 of the holding fitting part 7 are formed at a section where corner portions 12 tend to be lifted. At the both sides 11 of the holding fitting part 7, assembly holes 13 each having a circular shape are opened and formed. The assembly holes 13 are formed so as to penetrate from the front to the back faces. In a case that the shape of the locking projections 18 of the slider 4 is made for example to be rectangular, the assembly holes 13 are formed to match this shape.

The accommodation part 8 is a portion that is accommodated in a terminal penetration part 17 of the slider 4 over the whole width, and is formed in a flat shape on the front and back faces.

As illustrated in FIGS. 1 to 5, the slider 4 includes a basal part 14, a part that is inserted into a substrate connector (not illustrated) to be mechanically fitted therewith, and a part that guides the terminal 3 of the flat connecting member 2 inward of the substrate connector along with the fitting, and thus is formed into a shape as illustrated in the figures. Specifically, the slider 4 includes the basal part 14, a substrate connector insertion part 15, and a substrate connector fitting part 16, thus being formed into a shape as illustrated in the figures.

The terminal penetration part 17 and the pair of locking projections 18 are formed on the basal part 14. The terminal penetration part 17 is formed as a section through which the terminal 3 of the flat connecting member 2 penetrates. The terminal penetration part 17 is formed such that a space that matches the planar shape and cross-sectional shape of the terminal 3 is generated.

The terminal 3 is inserted into the interior through an entrance 19 of the terminal penetration part 17 with the connector connecting part 5 as a tip of the insertion. Thereafter, when the connector connecting part 5 is exited from an exit 20 of the terminal penetration part 17, the terminal 3 becomes in a penetrated state.

A middle holding part 21 is formed at the terminal penetration part 17. The middle holding part 21 is arranged at the exit 20 side of the terminal penetration part 17. The middle holding part 21 is formed such that it can hold the middle portion 10 of the holding fitting part 7 of the terminal 3 so that it does not bend.

The middle holding part 21 is arranged at a position opposite to a terminal mounting face 22 of the terminal penetration part 17. The middle holding part 21 is formed to have a length that matches the width of the middle portion 10. Further, the middle holding part 21 is arranged at a position that matches the middle portion 10. Therefore, stepped portions 23 are formed respectively at both sides of the middle holding part 21.

The pair of locking projections 18 are arranged and formed at positions facing on from the pair of stepped portions 23 when the basal part 14 is seen from the above. Each of the locking projections 18 is formed in a circular boss shape that protrudes vertically from the terminal mounting face 22. Each of locking projections 18 is formed in a shape that has a taper 24 on a side facing the exit 20 of the terminal penetration part 17. Each of locking projections 18 is formed in a shape that protrudes higher than an opening height of the exit 20. The locking projections 18 are formed as the portions to be fitted with the assembly holes 13 of the terminal 3.

The substrate connector insertion part 15 is formed as a portion to be inserted into the substrate connector (not illustrated). A connecting part mounting face 25 for mounting the connector connecting part 5 of the terminal 3 is formed on the substrate connector insertion part 15. A pair of terminal guide portions 26 are formed on the substrate connector insertion part 15. The terminal guide portions 26 are arranged at both sides of the connecting part mounting face 25 and are formed as portions that guide the pair of guide portions 6 of the connector connecting part 5.

The substrate connector fitting part 16 is formed as a portion to be fitted with the substrate connector (not illustrated). The substrate connector fitting part 16 is a portion having a lock structure.

In such a configuration and structure, assembly of the connector 1 composed of the terminal 3 of the flat connecting member 2 and the slider 4 is performed in one step of simply penetrating the terminal 3 through the slider 4, and fitting of the terminal 3 and the slider 4 is also performed along with the penetration.

Specifically, the terminal 3 is inserted into the entrance 19 of the terminal penetration part 17 of the slider 4 from the connector connecting part 5 side, and thereafter, when the connector connecting part 5 is exposed from the exit 20 to be mounted on the connecting part mounting face 25, the terminal 3 becomes in a penetrated state and the assembly is completed. At this time, the both sides 11 of the terminal 3 that are exposed from the exit 20 of the terminal penetration part 17 abut the pair of locking projections 18 to be bent temporarily, and thereafter, slide on the tapers 24 to become in a state of climbing over the locking projections 18. Then, once the assembly holes 13 fall on the locking projections 18, the both sides 11 return to the non-bending original state, which completes the fitting.

Even if one simply tries to pull out the flat connecting member 2 from the slider 4 in a fitting state of the connector 1, the assembly holes 13 of the terminal 3 do not come off from the locking projections of the slider 4. Specifically, the middle portion 10 in the width direction of the terminal 3 is held by the middle holding part 21 of the terminal penetration part 17, and in this state, even if one simply tries to pull out the flat connecting member 2 from the slider 4, the assembly holes 13 do not come off from the locking projections 18 which protrude higher than the opening height of the exit 20 of the terminal penetration part 17.

As explained by referring to FIGS. 1 to 5, with the connector 1 according to the embodiment, effects of reducing the number of component parts as well as improving the assembly performance can be achieved. Further, with the connector 1 according to the embodiment, an effect of improving the assembly reliability can be achieved.

What is claimed is:

1. A connector for a flat connecting member having a plurality of circuits, comprising:

a terminal portion provided at an end portion of the flat connecting member; and a resin slider to be assembled with the terminal portion, wherein the terminal portion comprises assembly holes provided at both sides in a width direction thereof respectively, the slider has a terminal penetration part through which the terminal portion penetrates and locking projections with which the assembly holes are fitted in a single assembly operation of the slider and the terminal portion, the terminal penetration part has a middle holding part which is arranged at an exit side of the terminal penetration part and which holds a middle portion of the terminal portion in the width direction thereof, and the locking projections are arranged at both sides of the middle holding part respectively, and are formed in a shape that temporarily bends the both sides of the terminal portion penetrated into the terminal penetration part and is exposed from the terminal penetration part such that the both sides of the terminal portion climb thereover in the single assembly operation.

2. The connector according to claim 1, wherein each of the locking projections comprises a taper shape over which the both sides of terminal portion climb.

3. The connector according to claim 1, wherein each of the locking projections is formed in a shape that protrudes higher than an opening height of an exit opening on the exit side of the terminal penetration part.

4. The connector according to claim 1, wherein the slider further comprises a basal part, and the terminal penetration part and the basal part are integral.

5. The connector according to claim 4, wherein the terminal penetration part and the locking projections are formed on the basal part, the terminal penetration part comprises a section through which the terminal portion of the flat connecting member penetrates, a shape of the section of the terminal penetration part matches a cross-sectional shape of the terminal portion.

6. The connector according to claim 2, wherein the taper is tapered in a direction such that a side of each of the locking projections on the exit side of the terminal penetration part is higher than a side of each of the locking projections on a penetration side of the terminal penetration part.

7. The connector according to claim 1, wherein each side of the middle holding part at the exit side thereof comprises a stepped portion forming an opening to the basal part, and each of the locking projections are located in a respective one of the openings next to the stepped portion of the middle holding part.

8. The connector according to claim 7, wherein a length of the middle holding part matches the width of a middle portion of the flat connecting member, a position of the middle holding part matches a penetrated position of the middle portion such that the stepped portions are positioned respectively at both sides of the middle holding part.

9. The connector according to claim 1, wherein each of the locking projections is formed in a circular boss shape that protrudes vertically from a mounting face of the terminal portion, and each of locking projections is has a taper on a side facing the exit of the terminal penetration part.

10. The connector according to claim 1, wherein the terminal portion further comprises a connector connecting part to be electrically connected with a substrate connector, the connector connecting part is accommodated in a connecting member housing of the substrate connector, the connector connecting part comprises exposed strip-like terminals.

11. The connector according to claim 2, further comprising:

an insertion state comprising an insertion of the terminal portion into the terminal penetration part of the slider, and a penetrated state comprising an exposure of a portion of the terminal portion from the exit side of the terminal penetration part, wherein in the insertion state both sides of the terminal portion that are exposed from the exit side of the terminal penetration part abut the pair of locking projections to be bent temporarily, and thereafter, slide on the tapers to climb over the locking projections, and in the penetrated state the assembly holes fall on the locking projections and the both sides of the terminal portion return to an original non-bent state.

* * * * *